United States Patent [19]

Salazar

[11] 4,017,106

[45] Apr. 12, 1977

[54] STRIKE PLATE FOR SPRING BOLT DOOR LATCHES

[76] Inventor: Charles Salazar, 2740 E. Indianapolis, Fresno, Calif. 93726

[22] Filed: Oct. 7, 1974

[21] Appl. No.: 512,457

[52] U.S. Cl. ..... 292/340; 70/416; 70/461

[51] Int. Cl.[2] ..... E05C 19/00

[58] Field of Search ..... 70/461, 416, 418; 292/346, 169

[56] References Cited

UNITED STATES PATENTS

| | | | |
|---|---|---|---|
| 1,563,667 | 12/1925 | Smith | 292/341.18 |
| 2,213,262 | 9/1940 | Segal | 70/461 |
| 2,403,182 | 7/1946 | Leary et al. | 292/341.18 |
| 2,692,158 | 10/1954 | Tirschel | 292/346 |
| 3,606,429 | 9/1971 | Palmer | 292/346 X |
| D34,243 | 3/1901 | Taylor | 292/346 X |

*Primary Examiner*—Richard E. Moore
*Attorney, Agent, or Firm*—Vergil L. Gerard

[57] ABSTRACT

Disclosed is a strike plate for doors with spring bolt latches which has a guard flange that projects at a right angle from the plate toward the leading edge of the door. The guard flange is located between the latch bolt and the outside of the door. The guard flange prevents cards, blades or other burglary devices from being inserted between the door edge and the jam for the purpose of releasing the latch bolt.

8 Claims, 7 Drawing Figures

STRIKE PLATE FOR SPRING BOLT DOOR LATCHES

BACKGROUND OF INVENTION

My invention relates generally to door latches and more particularly to strike plates of spring actuated locking latches.

In recent years the number of burglaries has increased dramatically and, as a result, property owners have become increasingly interested in devices for preventing unauthorized entry. Many locking devices are available which cannot be easily jimmied but they are either excessively expensive or so inconvenient for authorized access that they are unacceptable to most potential users.

The spring loaded latch is widely used on doors in residences and office premises because of its convenience but, unfortunately, it is quite vulnerable to experienced burglars. With such simple tools as a pocket knife or credit card most burglars can gain access through a door with this type of latch faster than a person with a key. They accomplish this by inserting a card, knife blade or other thin, flexible object between the door jam stop and the door edge until it engages the latch bolt and then manipulate it until the bolt is pressed inwardly against its loading spring and access is accomplished.

The deadlocking spring latch which has a deadlock trip rod on one side of the latch bolt is designed to prevent this defect in spring latches, however, in many cases it is not mounted or maintained with sufficient care to provide this protection. The deadlocking spring latch only functions properly when the deadlock trip rod engages the strike plate. If the latch bolt is misaligned with the strike plate or the door can be moved to cause this misalignment, the deadlock does not operate. Spring bolt latches are also incorporated in panic bar hardware for fire and emergency exits where the same vulnerability to unathorized access exists.

Various devices have been suggested to overcome these difficulties but prior to my invention all have been either too expensive and complex, or not truly effective. A need, therefore, exists for a simple, inexpensive, yet truly effective device to make the spring bolt door latch burglarproof.

It is, therefore, a major object of my invention to provide an improved strike plate which renders spring bolt latches substantially burglarproof.

It is another object of my invention to provide an improved strike plate of the type described which will fit in the place of strike plates now in use without alterations to the door or jam.

Still a further object of my invention is to provide an improved latch plate of the type described which does not reveal its presence and, therefore, thwarts attempted countermeasures.

Yet another object of my invention is to provide an improved latch plate of the type described which is readily adaptable to a variety of door conditions and is simple to install and inexpensive to make.

These and other objects of my invention will become more readily apparent from the following detailed description of a preferred embodiment and the accompanying drawings in which.

Figure 7:
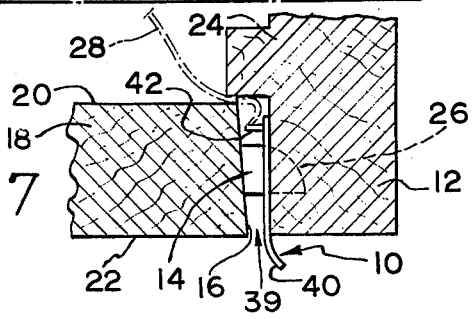
FIG. 7 is a top plan view of my preferred embodiment shown installed with a spring latch, the door and jam being shown in cutaway.
Figure 6:
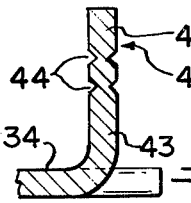
FIG. 6 is a sectional view taken on 6—6 in FIG. 2.

Referring now to the drawings, the numeral 10 designates my improved strike plate generally. The strike plate 10 is shown mounted in place of a presently used strike plate on a door jam 12. In FIG. 7, spring loaded latch bolt 14 is shown projecting from a leading edge 16 of a door 18. The door 18 has an outside 20 and an inside 22, these sides being disposed respectively in an outside area and an inside area, and the leading edge 16 is tapered or feathered inwardly to permit clearance between the door and the jam 12 when the door swings open and closed. The amount of this taper is exaggerated in the drawings for convenience of illustration.

Figure 1:
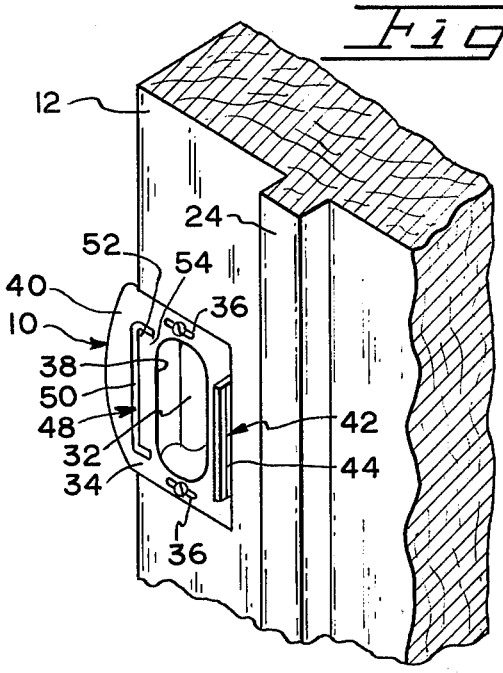
FIG. 1 is a perspective view of a door jam with a preferred embodiment of my invention incorporated therein.
Figure 4:
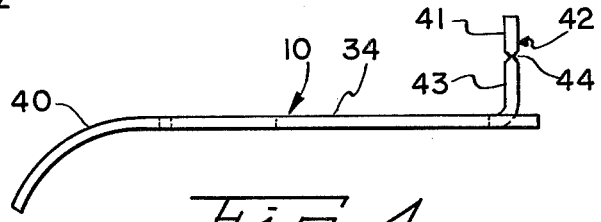
FIG. 4 is a bottom plan view of my preferred embodiment.
Figure 5:
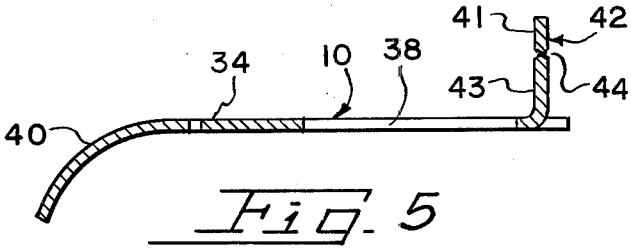
FIG. 5 is a sectional view taken on 5—5 in FIG. 2.
Figure 2:
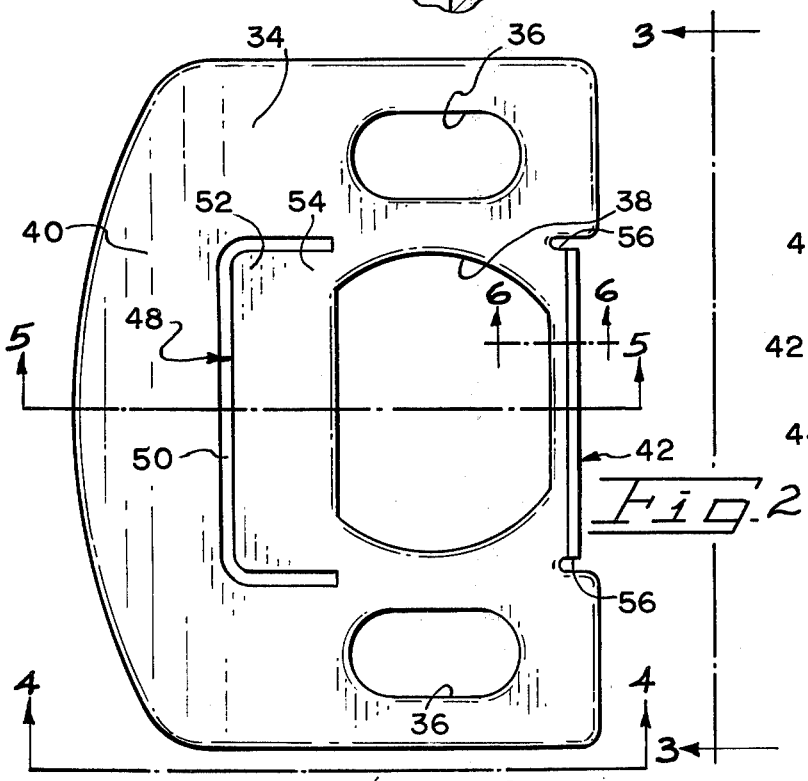
FIG. 2 is an enlarged side elevational view of my preferred embodiment.
Figure 3:
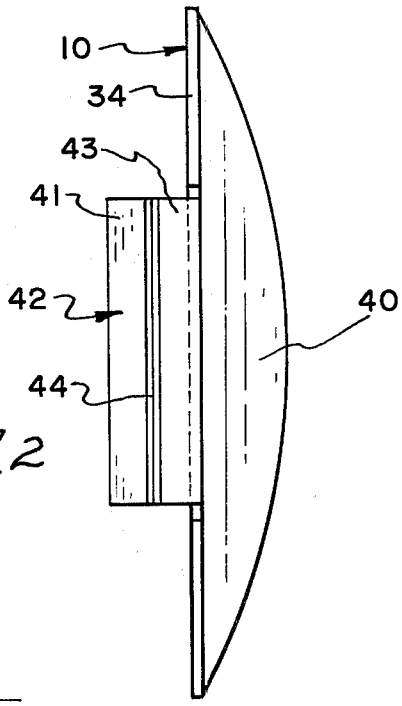
FIG. 3 is an end view of my preferred embodiment.

As shown in FIGS. 1 and 7, the door 18 is mounted for inside swing and has a stationary stop 24 on the jam 12 against which the outside 20 of the door strikes when the door closes. The outer end of the latch bolt 14 is contoured into a cam surface 26 so the bolt is easily driven inward into the door when it hits the strike plate on closing. A jimmy device 28 is shown in phantom in FIG. 7 wedged between the door outside 20 where it joins the edge 16 and the stationary stop 24. But for a guard flange 42 provided on my strike plate as hereafter explained, the jimmy device would reach the bolt 14 and by proper manuevering, the bolt could then be worked out of the bolt hole 32 to permit access through the door. In FIG. 2 my strike plate 10 is seen to have a base 34 with screw holes 36 for mounting screws and a bolt opening 38 for receiving the end of the latch bolt 14. The screw holes 36 are horizontally elongated to permit adjustment of the strike plate, as hereafter explained.

The strike plate 10 has a lip 40 on its leading edge which is angularly offset to provide a cam surface for driving the spring loaded latch bolt 14 inwardly as the door swings closed.

At its trailing edge, the strike plate 10 has a guard flange 42 which is formed integrally with the base 34 and projects at a right angle to the surface of the base toward the leading edge 16 of the door a distance substantially equal to the swing space 39 between the door 18 and the jam 12. The proximal portion 41 of the guard flange 42 is attached adjacent the bolt opening 38 to position the distal portion 43 in the swing space 39 between the bolt opening and the outside 20 of the door, and the flange extends over the full height of the bolt opening.

To permit adjustment of the height of the guard flange 42, the flange has laterally directed scores 44 which permit a distal portion 43 to be removed by repeated bending therealong. Thus, where the swing space 39 between the door leading edge 16 and the surface of the jam 12 is less than normal, my strike plate 10 is still usable without modification of the jam or door edge.

Since my improved strike plate 10 achieves its beneficial results by preventing jimmy tools from reaching the latch bolt 14, its effectiveness is maximized by locating the guard flange 42 as close to the bolt 14 as practically possible. This placement further aids in preventing the passage of any instrument past the guard flange 42 and into contact with the bolt 14. The horizontally elongated screw holes 36 permit adjustment of the strike plate for this purpose.

It should thus be understood that when an ordinary strike plate is replaced with my improved strike plate 10, the most vulnerable aspect of a spring bolt latch is eliminated. Insertion of tools in the door crack to work the bolt 14 out of the bolt hole 32 is prevented by the presence of guard flange 42. Moreover, the presence of this guard flange is not evidenced to the person attempting unauthorized entry, so he has no opportunity to thwart its effect.

Some outside doors upon which my strike plate 10 is needed for protection, open outwardly rather than inwardly. These are especially vulnerable to release by means of bolt manipulation because the stationary stop 24 is on the inside and does not help to limit the burglar's working space. For such installations my strike plate 10 is modified by using an alternate guard flange 48. The alternate guard flange 48 is formed in the base plate 34 adjacent the opposite side of the bolt opening 38 just past the lip 40 by provision of the cutout area 50. The flange 48 is placed in use position by bending its distal end 52 away from the base plate face surface where its proximal end 54 is attached until it projects at about a right angle thereto. Although in this modification of may invention the bolt 14 must pass over the guard flange 48 when the door is opened or closed, this is no deterrent to its effectiveness since the bolt in any proper installation can be drawn or driven into the door at least far enough to be flush with the door edge 16.

When the alternate guard flange 48 is used, the principal guard flange 42 can be left in place since it in no way interfers with the proper functioning of the door latch.

Although the alternate guard flange 48 could be formed with score lines similar to those in the guard flange 42 for adjusting the projection distance of the flange, these have not been provided since this adjustment can be achieved during the bending out of the flange into its use position. Since the alternate guard flange 48 is bent into use position at the site of installation, the installer may adjust the distance of its projection by regulating the severity and angle of the bend at its proximal end 54.

For greater projection, a sharp bend and a ninety degree angle will be used, and for less projection the bend will be made more gradual and the angle will be a number of degrees on either side of 90°, such as 80° or 100°.

From FIG. 2 of the drawings, it will be seen that relief slots 56 are provided at the ends of the guard flange 42 where it joins the base plate 34. These slots permit easy bending of the guard flange out of surface alignment with the base plate in accordance with known and accepted metal stamping practices. This structure illustrates that I contemplate my strike plate being formed from a metal stamping with the guard flange bent into its use position during manufacture. It could, of course, be left in its original stamped condition in alignment with the base plate and bent into use position in the field in the manner described for alternate guard flange 48.

From this detailed description of a preferred embodiment of my invention it should be understood that it is fully capable of providing the advantages and achieving the objects attributed to it. Particularly, it should be readily apparent to those skilled in the art that I have provided a simple, inexpensive, yet fully effective means of thwarting unauthorized entry through doors using spring loaded bolt latches.

I claim:

1. An improved strike plate for a spring bolt door latch for latching the lead edge of a door to the door jam of a door opening disposed between an inside area and an outside area, comprising:

a planar base plate with a back surface and a face surface, said base plate having a leading edge deflected out of alignment with said base plate plane in the direction of said back surface to provide a latch cam surface, and a trailing edge disposed on the opposite edge of said base plate from said leading edge, and said base plate having a latch bolt opening therein disposed between said leading edge and said trailing edge;

mounting means on said base plate for securing said base plate to said door jam with its back surface against said jam and said latch bolt opening aligned with a bolt recess in said jam;

a first guard flange interconnected with said base plate and positioned to project from said base plate outwardly from and substantially normal to said face surface thereof and disposed adjacent said latch bolt opening on the side thereof closest to the trailing edge of said base plate to prevent access to said spring bolt through the swing space between said door jam and the lead edge of said door when said base plate is mounted to said door jam by mounting means; and an alternate guard flange interconnected with said base plate and disposed on the opposite side of said latch bolt opening from said first mentioned guard flange and between said base plate leading edge and said latch bolt opening, and positioned to be bent to project from said base plate outwardly from said face surface sufficient to prevent access to said spring bolt through said swing space between said door jam and the lead edge of said door when said base plate is mounted to said door by said mounting means, whereby said strike plate can be arranged to accommodate either an inside or outside opening door by utilization of either said first guard flange or said alternate guard flange, and said alternate guard flange is so positioned that said spring bolt engages and passes over the same upon closing of said door and engagement of said alternate guard flange by said spring bolt is avoided when said spring bolt is fully withdrawn into said spring bolt latch for opening said door.

2. An improved strike plate as described in claim 1 in which:

said guard flanges have projection adjustment means incorporated therein which permit adjustment of the projection distance of said flanges from said face surface of said base plate.

3. An improved strike plate as described in claim 1 in which:

said guard flanges are formed integral with said base plate and are disposed for bending into a substantially normal position with respect to said base plate face surface prior to mounting of said strike plate in said door jam by said mounting means.

4. An improved strike plate as described in claim 1 in which:

said mounting means includes a mounting screw hole elongated to permit linear reciprocal movement of said base plate in the direction of said leading edge and trailing edge about a screw disposed in said screw hole and engaged with said door jam; and

5. An improved strike plate as described in claim 2, in which:

said first guard flange projection adjustment means includes a groove disposed laterally of said flange to permit severance of the distal portion of said flange from the proximal portion thereof upon repeated bending therealong.

6. In a doorway structure having a door frame disposed between an inside area and an outside area, a door jam formed on one side of said door frame, a door hinge mounted in said door frame along the side opposite said door jam and having a leading door edge disposed adjacent said door jam and spaced therefrom by a swing space, a spring bolt door latch mounted in the leading edge of said door, and a spring bolt recess formed in said door jam in receiving alignment with said spring bolt when said door is closed in said door frame, an improved strike plate comprising:

a base plate with a back surface and a face surface; said base plate having a leading edge and an oppositely disposed trailing edge;

means defining a bolt opening through said base plate between said leading edge and said trailing edge;

mounting means on said base plate for securing said base plate to said door jam with said back surface contacting said door jam with said back surface contacting said door jam and said face surface directed toward said leading door edge, with said bolt opening aligned with said spring bolt recess, and with said leading edge directed toward said inside area and said trailing edge directed toward said outside area a first guard flange mounted on said base plate between said trailing edge and said bolt opening and projecting from said face surface of said base plate into said swing space substantially the full width thereof; and a second guard flange mounted on said base plate between said leading edge and said bolt opening and projecting from said face surface of said base plate into said swing space for a major portion of the width thereof leaving a minor portion of the width thereof to pass said spring bolt over said second guard flange when said door is swung open in the direction of said leading edge with said spring bolt withdrawn into said door.

7. An improved strike plate as described in claim 6, in which:

said guard flanges are formed integral with said base plate and are bent into said projecting positions from said base plate prior to mounting of said base plate on said door jam.

8. An improved strike plate as described in claim 6, in which:

said flanges have adjustment means for regulating the distance of their projection from said face surface of said base plate.

* * * * *